US010288244B2

(12) United States Patent
Furubayashi

(10) Patent No.: US 10,288,244 B2
(45) Date of Patent: May 14, 2019

(54) VEHICLE LIGHTING FIXTURE

(71) Applicant: Stanley Electric Co., Ltd., Tokyo (JP)

(72) Inventor: Kazuya Furubayashi, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/793,065

(22) Filed: Oct. 25, 2017

(65) Prior Publication Data

US 2018/0119917 A1 May 3, 2018

(30) Foreign Application Priority Data

Oct. 31, 2016 (JP) ..... 2016-212470

(51) Int. Cl.
*F21S 41/24* (2018.01)
*F21S 41/19* (2018.01)
(Continued)

(52) U.S. Cl.
CPC ..... *F21S 41/24* (2018.01); *F21S 41/192* (2018.01); *F21S 43/241* (2018.01);
(Continued)

(58) Field of Classification Search
CPC ..... F21S 41/24; F21S 41/192; F21S 41/255; F21S 41/275; F21S 41/285; F21S 41/331;
(Continued)

(56) References Cited

U.S. PATENT DOCUMENTS 5,228,766 A * 7/1993 Makita ..... B60Q 1/007 362/538
6,299,334 B1 * 10/2001 Schwanz ..... B60Q 1/2665 362/511
(Continued)

FOREIGN PATENT DOCUMENTS

DE 10 2010 054 923 A1 6/2012
DE 10 2011 018 508 A1 10/2012
(Continued)

OTHER PUBLICATIONS

The extended European search report for the related European Patent Application No. 17199052.6 dated Mar. 28, 2018.

*Primary Examiner* — Daniel I Walsh
(74) *Attorney, Agent, or Firm* — Kenealy Vaidya LLP

(57) ABSTRACT

A vehicle lighting fixture capable of improving the visual recognizability when seen from its front oblique direction is provided. The vehicle lighting fixture includes: a light guide plate having a front light emission surface extending in a circular arc shape. A plurality of lens cut surfaces is formed in the front light emission surface to extend in a circular arc shape, the lens cut surfaces being recessed rearward and formed in a concentric manner. A structural body is provided to the rear surface thereof to diffuse and reflect light guided within the light guide plate in order for the light to exit through the front light emission surface. The light guide plate is formed in a substantially circular truncated conical shape where the light guide plate on an outer peripheral side is located rearward more than on an inner peripheral side.

12 Claims, 8 Drawing Sheets

(51) Int. Cl.
*F21S 43/241* (2018.01)
*F21S 43/245* (2018.01)
*F21S 43/249* (2018.01)
*F21S 43/14* (2018.01)

(52) U.S. Cl.
CPC ..... *F21S 43/245* (2018.01); *F21S 43/249* (2018.01); *F21S 43/14* (2018.01)

(58) Field of Classification Search
CPC ..... F21S 43/241; F21S 41/245; F21S 41/249; F21S 41/14; F21S 41/235
See application file for complete search history.

(56) References Cited

U.S. PATENT DOCUMENTS 6,356,394 B1 * 3/2002 Glienicke ..... B60Q 3/64 359/641
7,452,114 B2 * 11/2008 Gasquet ..... B60Q 1/2696 362/511
7,581,862 B2 * 9/2009 Stefanov ..... F21S 48/1241 362/551
8,256,918 B2 * 9/2012 Chaves ..... G02B 6/0096 362/216
10,168,017 B2 * 1/2019 Tokieda ..... B60Q 1/0047
2003/0026106 A1 * 2/2003 Knaack ..... B60Q 1/0052 362/511
2003/0206408 A1 * 11/2003 Funamoto ..... G02B 6/0036 362/603
2004/0096182 A1 * 5/2004 Yamashita ..... G02B 6/0018 385/146
2004/0184286 A1 * 9/2004 De Lamberterie .. B60Q 1/0052 362/559
2005/0141213 A1 * 6/2005 Gasquet ..... B60Q 1/2696 362/35
2006/0061286 A1 * 3/2006 Coushaine ..... F21K 9/00 315/76
2008/0232127 A1 * 9/2008 Futami ..... F21V 7/09 362/511
2008/0259620 A1 * 10/2008 Oba ..... F21S 43/249 362/487
2009/0154186 A1 * 6/2009 Natsume ..... B60Q 1/0041 362/516
2010/0026703 A1 * 2/2010 Parker ..... G02B 6/0046 345/589
2011/0013411 A1 * 1/2011 Sakiyama ..... B60Q 1/2665 362/494
2011/0103084 A1 * 5/2011 Zwick ..... G02B 6/0036 362/511
2011/0242830 A1 * 10/2011 Okui ..... F21S 41/141 362/511
2011/0292671 A1 * 12/2011 Ishihara ..... F21S 43/235 362/522
2012/0218775 A1 * 8/2012 Nakada ..... G02B 6/0006 362/602
2013/0003398 A1 * 1/2013 Godbillon ..... G02B 6/001 362/511
2013/0003399 A1 * 1/2013 de Lamberterie .. F21S 48/1241 362/511
2013/0044503 A1 * 2/2013 Mihara ..... F21S 41/143 362/511
2013/0182453 A1 * 7/2013 Masuda ..... G02B 6/0096 362/511
2013/0343061 A1 * 12/2013 Liao ..... G02B 6/0035 362/296.01
2014/0056015 A1 * 2/2014 Martoch ..... G02B 6/0018 362/487
2014/0160778 A1 * 6/2014 Nakada ..... G02B 6/002 362/511
2014/0268871 A1 * 9/2014 Morgan ..... H01L 31/0543 362/607
2015/0219303 A1 * 8/2015 Kai ..... B60Q 1/0052 362/551
2015/0292704 A1 * 10/2015 Koshiro ..... F21S 48/2237 362/511
2016/0040845 A1 * 2/2016 Kuo ..... F21V 5/04 362/518
2016/0069525 A1 * 3/2016 Chen ..... F21S 48/1241 362/612
2016/0091653 A1 * 3/2016 Ban ..... G02B 6/0043 362/613
2016/0102834 A1 * 4/2016 Yamada ..... G02B 6/0061 362/511
2016/0102835 A1 * 4/2016 Baccarin ..... F21S 48/24 362/516
2016/0208995 A1 * 7/2016 Yoshino ..... F21S 48/2212
2016/0252228 A1 * 9/2016 Martinez ..... G02B 6/0018 362/511
2016/0369969 A1 * 12/2016 Tokieda ..... F21S 43/249
2017/0038024 A1 * 2/2017 Imazeki ..... G02B 17/006
2017/0097133 A1 * 4/2017 Lee ..... G02B 6/001
2017/0205044 A1 * 7/2017 Tokieda ..... B60Q 1/34
2017/0234501 A1 * 8/2017 Hanami ..... G02B 6/0006 362/511
2017/0267163 A1 * 9/2017 Watanabe ..... F21S 43/40
2017/0336045 A1 * 11/2017 Kobayashi ..... F21S 43/40
2018/0112847 A1 * 4/2018 Childress ..... F21S 41/24
2018/0119917 A1 * 5/2018 Furubayashi ..... F21S 41/24

FOREIGN PATENT DOCUMENTS

DE 10 2013 100 561 A1 7/2014
EP 3 018 402 A1 5/2016
JP 2013-122872 A 6/2013

* cited by examiner

VEHICLE LIGHTING FIXTURE

This application claims the priority benefit under 35 U.S.C. § 119 of Japanese Patent Application No. 2016-212470 filed on Oct. 31, 2016, which is hereby incorporated in its entirety by reference.

TECHNICAL FIELD

The presently disclosed subject matter relates to a vehicle lighting fixture, and in particular, to a vehicle lighting fixture using a circular arc-shaped light guide plate.

BACKGROUND ART

A conventional vehicle lighting fixture proposed in, for example, JP2013-122872A (for example, FIG. 1) can include a light source, and a circular arc-shaped light guide plate for guiding light from the light source, with a plurality of reflecting elements formed in the light guide plate, and the light can enter the light guide plate at its one end and guided to the other end. During guiding the light, part of the light can be reflected by the plurality of reflecting elements of the light guide plate to exit the light guide plate through its front surface.

In the vehicle lighting fixture of the aforementioned publication, the front surface, or light emission surface of the light guide plate is formed to be flat and directed forward. This configuration may adversely reduce the visual recognizability of the light guide plate when the vehicle lighting fixture is turned on and seen from its front oblique direction, resulting in reduction of performance as the vehicle lighting fixture.

SUMMARY

The presently disclosed subject matter was devised in view of these and other problems and features in association with the conventional art. According to an aspect of the presently disclosed subject matter, a vehicle lighting fixture utilizing a light guide plate with a circular arc shape can improve the visual recognizability of the light guide plate when seen from its front oblique direction.

According to another aspect of the presently disclosed subject matter, a vehicle lighting fixture can include: a light guide portion; and at least one light source configured to emit light that is allowed to enter the light guide portion, the light guide portion including a light guide plate formed in a circular arc shape and having a first end portion, a second end portion, a front light emission surface extending between the first end portion and the second end portion in a circular arc shape, a rear surface opposite to the front light emission surface, an inner peripheral surface, an outer peripheral surface, a plurality of lens cut surfaces formed in the front light emission surface to extend in a circular arc shape, the lens cut surfaces being recessed rearward (meaning that these portions are projected forward and the inner surfaces thereof are the recessed lens cut surfaces) and formed in a concentric manner, and a structural body provided to the rear surface of the light guide plate, the structural body being configured to diffuse and reflect light guided within the light guide plate in order for the light to exit through the front light emission surface. Here, the light guide plate can be formed in a substantially circular truncated conical shape where a part of the light guide plate on an outer peripheral side is located rearward more than a part of the light guide plate on an inner peripheral side is.

According to this aspect, the vehicle lighting fixture utilizing the circular arc-shaped light guide plate can improve the visual recognizability when seen from its front oblique direction relative to the light guide plate.

This is because the light guide plate can be formed in a substantially circular truncated conical shape where the outer part of the light guide plate on the outer peripheral side is located rearward more than the inner part of the light guide plate on the inner peripheral side is.

Further, according to this aspect, the vehicle lighting fixture can provide a novel appearance with aesthetic feature.

This is because the light guide plate can be formed in a substantially circular truncated conical shape where the outer part of the light guide plate on the outer peripheral side is located rearward more than the inner part of the light guide plate on the inner peripheral side is, and the plurality of rearwardly recessed lens cut surfaces are formed in the front light emission surface to extend in a circular arc shape and in a concentric manner.

In a preferred exemplary embodiment of the presently disclosed subject matter, the vehicle lighting fixture can be configured such that the at least one light source includes a first light source configured to emit light that can enter the light guide plate through the first end portion and be guided within the light guide plate, and a second light source configured to emit light that can enter the light guide plate through the second end portion and be guided within the light guide plate.

According to this exemplary embodiment, the light can be projected through the front light emission surface of the light guide uniformly or substantially uniformly.

In a preferred exemplary embodiment of the presently disclosed subject matter, when the circular truncated conical shape has a center axis being defined as an axial line of the light guide plate and LT represents a thickness of the light guide plate along the axial line of the light guide plate and MT represents a depth of the light guide plate along the axial line of the light guide plate, the vehicle lighting fixture can satisfy a relation of $LT \leq MT \leq 3 \times LT$.

Furthermore, in a preferred exemplary embodiment of the presently disclosed subject matter, the lens cut surfaces can each be a cylindrical lens surface, and the structural body can be a plurality of V grooves provided radially with respect to the axial line of the light guide plate.

According to this exemplary embodiment, even when the plurality of cylindrical lens surfaces provided to the front light emission surface of the light guide plate in a concentric manner and extending in a circular arc shape overlap the plurality of radially extending V grooves provided to the rear surface, moiré can be prevented from occurring.

In a preferred exemplary embodiment of the presently disclosed subject matter, the light guide plate can include a first extension portion having a base end portion provided to the first end portion of the light guide plate and extending rearward, and a second extension portion having a base end portion provided to the second end portion of the light guide plate and extending rearward. The first extension portion can have a tip end portion provided with a cylindrical lens surface through which the light from the first light source enters the first extension portion. Between the base end portion of the first extension portion and the first end portion of the light guide plate, there can be provided a first reflection surface disposed to be inclined such that the light emitted from the first light source and guided within the first extension portion can be internally reflected by the first reflection surface to enter the light guide plate through the first end portion. The second extension portion can have a tip end portion provided with a cylindrical lens surface through which the light from the second light source enters the second extension portion. Between the base end portion of the second extension portion and the second end portion of the light guide plate, there can be provided a second reflection surface disposed to be inclined such that the light emitted from the second light source and guided within the second extension portion can be internally reflected by the second reflection surface to enter the light guide plate through the second end portion.

According to this exemplary embodiment, the first light source and the second light source can be disposed on the rear surface side of the light guide plate.

In a preferred exemplary embodiment of the presently disclosed subject matter, the first reflection surface and the second reflection surface can be provided with a plurality of cylindrical lens surfaces recessed rearward.

According to this exemplary embodiment, the light that is emitted from the first light source (second light source) and internally reflected by the first reflection surface (second reflection surface) to enter the light guide plate through the first end portion (second end portion) can be distributed uniformly or substantially uniformly in light amount in a width direction.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

Figure 1:
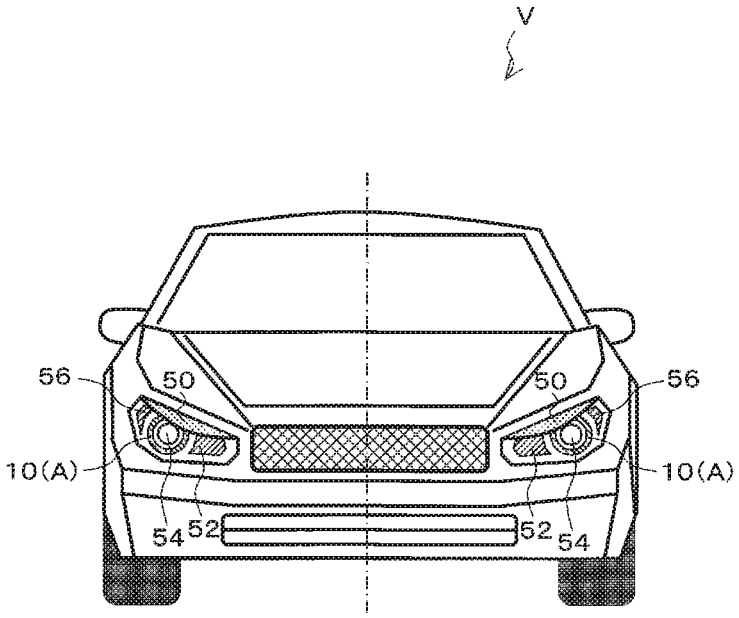
FIG. 1 is a front view of a vehicle body V to which a vehicle lighting fixture 10 made in accordance with principles of the presently disclosed subject matter is mounted.

A description will now be made below to vehicle lighting fixtures of the presently disclosed subject matter with reference to the accompanying drawings in accordance with exemplary embodiments. Herein, the same or corresponding components are denoted by the same reference numerals in the respective drawings, and descriptions therefor will be appropriately omitted.

It should be noted that the directions are basically defined assuming that the vehicle lighting fixture is mounted in a vehicle body and the "front direction" used herein is defined to be a light emitting direction in which light is mainly emitted from the vehicle lighting fixture.

FIG. 1 is a front view of a vehicle body V to which a vehicle lighting fixture 10 made in accordance with the principles of the presently disclosed subject matter is mounted.

The vehicle lighting fixture 10 illustrated in FIG. 1 can be a marker lamp (or a signal lamp) that can serve as a front position lamp (or DRL lamp), for example, and to be mounted on the vehicle body V at front left and right areas thereof.

To the front left and right end portions of the vehicle body V, there may also be a top part 50 of an outer lens, a lighting unit 52 for high beam, a lighting unit 54 for low beam, and a turn signal lamp 56 in addition to the vehicle lighting fixture 10.

The vehicle lighting fixture 10 can include a light emission region A having a circular arc shape when seen from its front side. The light emission region A can be arranged so as to surround the other vehicle lighting fixtures (in FIG. 1, the lighting unit 54 for low beam, for example). Specifically, the vehicle lighting fixture 10 can include a light guiding portion constituted of a light guide plate 20 having a front light emission surface 20*c* that can constitute the light emission region A.

Figure 2:
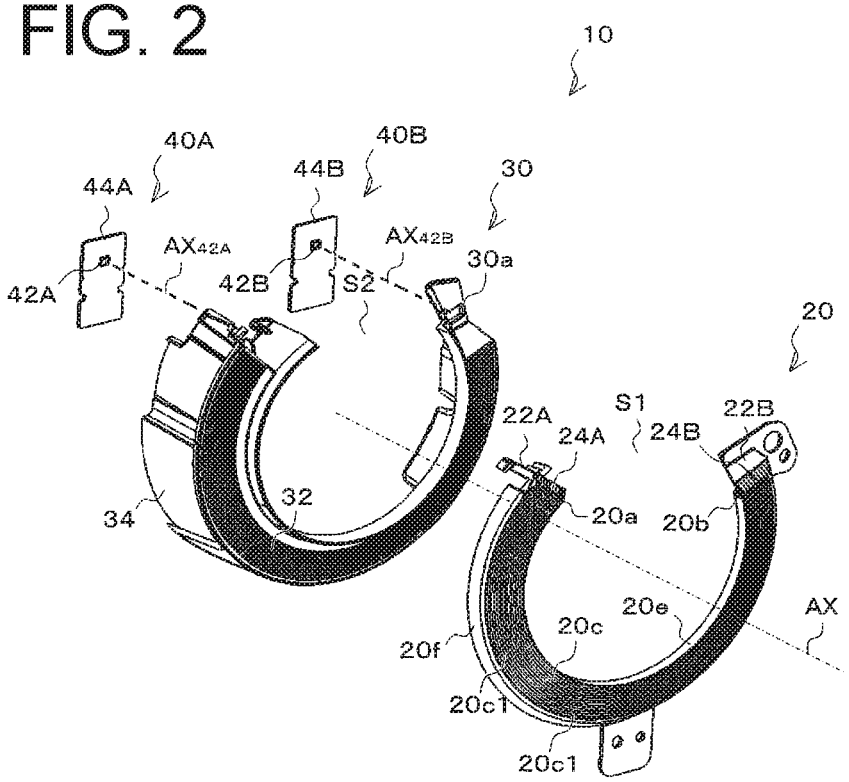
FIG. 2 is an exploded perspective view of the vehicle lighting fixture 10 when seen from its front side.
Figure 3A:
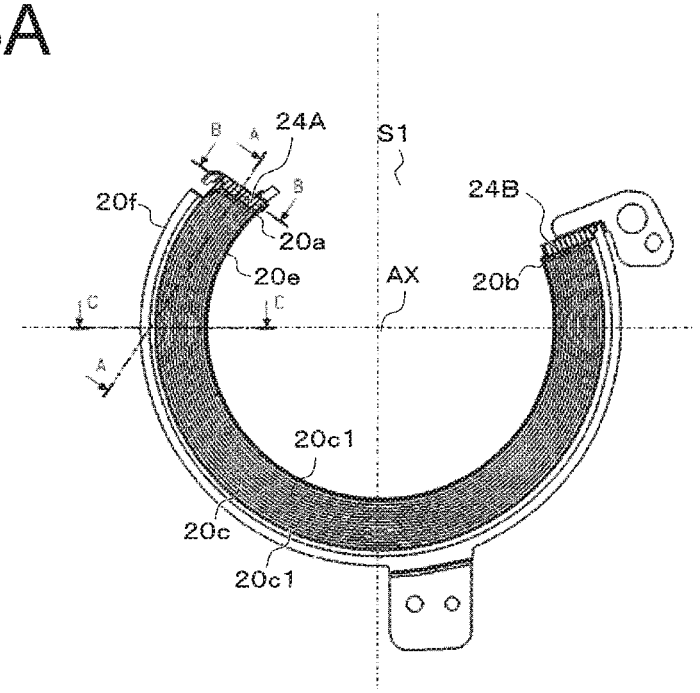
FIG. 3A is a front view of the vehicle lighting fixture 10.
Figure 3B:
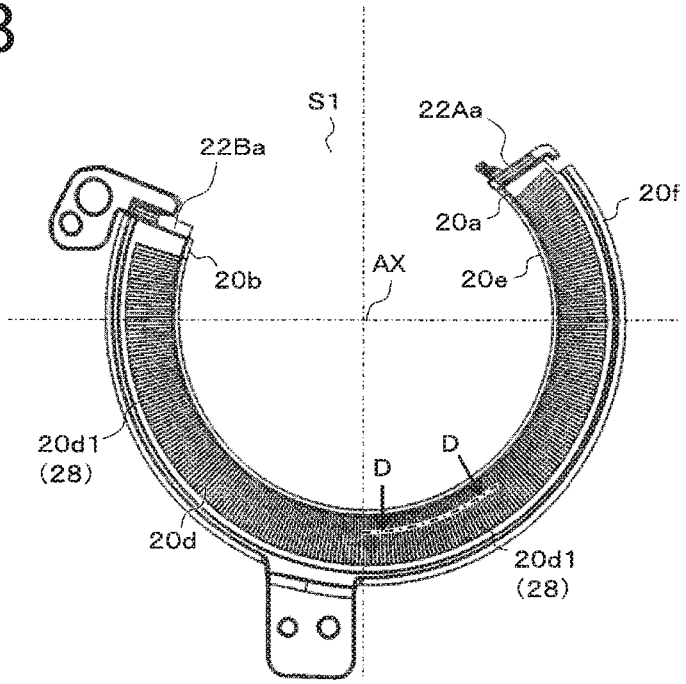
FIG. 3B is a rear view of the vehicle lighting fixture 10.
Figure 4:
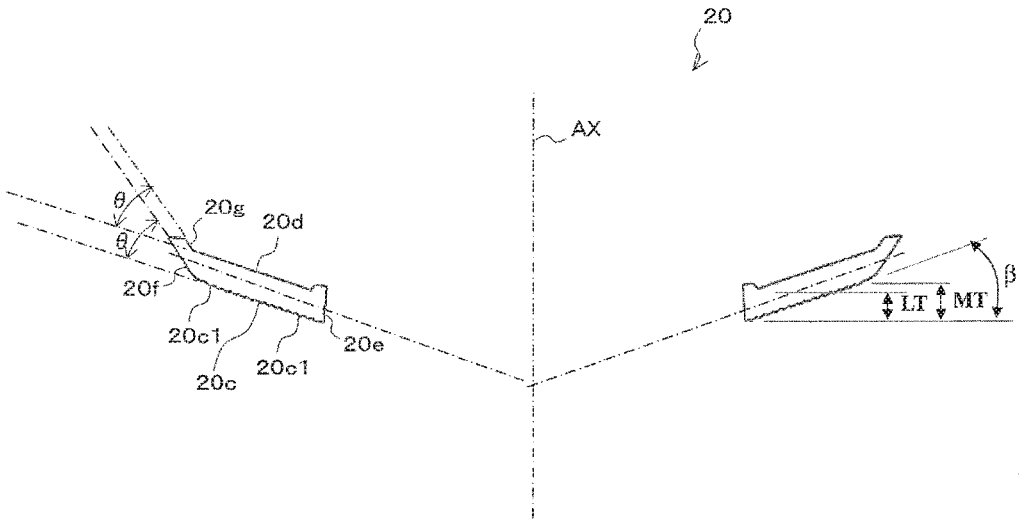
FIG. 4 is a cross-sectional view of the vehicle lighting fixture 10 taken along line C-C of FIG. 3A.

FIG. 2 is an exploded perspective view of the vehicle lighting fixture 10 when seen from its front side, FIG. 3A is a front view of the vehicle lighting fixture 10, and FIG. 3B is a rear view of the vehicle lighting fixture 10. Furthermore, FIG. 4 is a cross-sectional view of the vehicle lighting fixture 10 taken along line C-C of FIG. 3A.

As illustrated in FIG. 2, the vehicle lighting fixture 10 of this exemplary embodiment can include the light guide plate 20, an auxiliary reflecting mirror 30, a first light source 40A, a second light source 40B, and the like. Here, there may be an outer lens and a housing (not illustrated) that can constitute a lighting chamber, in which the vehicle lighting fixture 10 can be disposed.

As shown in FIG. 2 and FIGS. 3A and 3B, the light guide plate 20 can be formed in a circular arc shape, and include a first end portion 20*a*, a second end portion 20*b*, the front light emission surface 20*c* extending between the first end portion 20*a* and the second end portion 20*b* in a circular arc shape, a rear surface 20*d* opposite to the front light emission surface 20*c*, an inner peripheral surface 20*e*, and an outer peripheral surface 20*f*.

The light guide plate 20 can include a cutout portion S1 in the circular arc shape so that the first end portion 20*a* and the second end portion 20*b* are separated by the cutout portion S1.

As illustrated in FIG. 4, the light guide plate 20 can be formed in a substantially circular truncated conical shape where a part of the light guide plate 20 on an outer peripheral side (outer peripheral surface 20*f* side) is located rearward more than a part of the light guide plate 20 on an inner peripheral side (inner peripheral surface 20*e* side) is. Specifically, the front light emission surface 20*c* and the rear surface 20*d* of the light guide plate 20 can be formed in a substantially circular truncated conical shape where the outer side (for example, on the side of the outer peripheral surface 20*f*) is located rearward more than the inner side (for example, on the side of the inner peripheral surface 20*e*) is.

When the circular truncated conical shape of the light guide plate 20 has a center axis being defined as an axial line AX (see FIGS. 2 to 4) of the light guide plate 20 and LT represents a thickness of the light guide plate 20 along the axial line AX of the light guide plate 20 and MT represents a depth of the light guide plate 20 along the axial line AX of the light guide plate 20, the light guide plate 20 of the vehicle lighting fixture 10 can be configured to satisfy a relation of $LT \leq MT \leq 3 \times LT$.

When $MT < LT$, light is leaked out through the outer peripheral surface 20*f* more, and the amount of the light exiting through the front light emission surface 20*c* is reduced more with the increasing distance from the first end portion 20*a* (and the second end portion 20*b*) of the light guide plate 20. This causes the light emission appearance to be uneven.

When $3LT < MT$, the inclination angle β of the front light emission surface 20*c* is undesirably large. In this case, the widened angle of the light emission direction may reduce the front brightness.

Thus, it is desirable to satisfy the relation of $LT \leq MT \leq 3 \times LT$. More preferably, a relation of $LT \leq MT \leq 2 \times LT$ to $3 \times LT$ is satisfied from the viewpoint of the favorable visual recognizability and appearance.

The front light emission surface 20*c* of the light guide plate 20 can be arranged to be substantially parallel with the rear surface 20*d* with a distance therebetween of about 3 mm.

As illustrated in FIG. 4, the outer peripheral surface 20*f* can be provided to the outer rim of the front light emission surface 20*c*. Specifically, the outer peripheral surface 20*f* can be inclined rearward by an angle θ (acute angle) with respect to the front light emission surface 20*c* in consideration of aesthetic feature (design). Similarly, there can also be provided an extension surface 20*g* to the outer rim of the rear surface 20*d*. The extension surface 20*g* can be inclined rearward by an angle θ (acute angle) with respect to the rear surface 20*d*.

Figure 5A:
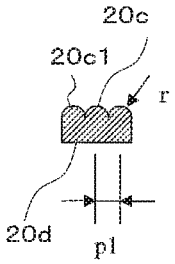
FIG. 5A is a partial enlarged schematic cross-sectional view of a front light emission surface 20*c* of the vehicle lighting fixture 10 taken along line C-C of FIG. 3A.
Figure 5B:
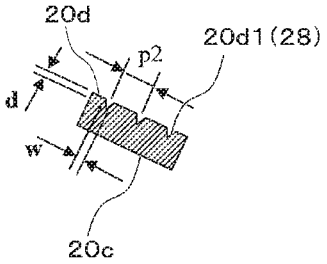
FIG. 5B is a partial enlarged schematic cross-sectional view of a rear surface 20*d* of the vehicle lighting fixture 10 taken along line D-D of FIG. 3B.

FIG. 5A is a partial enlarged schematic cross-sectional view of the front light emission surface 20*c* of the vehicle lighting fixture 10 taken along line C-C of FIG. 3A, and FIG. 5B is a partial enlarged schematic cross-sectional view of the rear surface 20*d* of the vehicle lighting fixture 10 taken along line D-D of FIG. 3B.

As illustrated in FIGS. 3A and 5A, the front light emission surface 20*c* of the light guide plate 20 can be provided with a plurality of cylindrical lens surfaces 20*c*1 that extend in a circular arc shape (being the outer shape of the light guide plate 20) and are formed in a concentric manner while being recessed rearward for internal reflection, which will be described in detail later (the cylindrical lens shape is projected forward). Note that FIG. 5A shows a C-C cross section of a part of the light guide plate 20 at its front side where three consecutive cylindrical lenses are shown.

For example, the radius of curvature r of each cylindrical lens surface 20*c*1 and the pitch p1 thereof may be 3 mm and 1 mm, respectively, for example.

The rear surface 20*d* of the light guide plate 20 can be provided with a structural body 20*d*1 configured to diffuse and reflect light guided within the light guide plate 20 in order for the light to exit through the front light emission surface 20*c*.

The structural body 20*d*1 can be a plurality of V grooves 20 provided radially with respect to the axial line AX of the light guide plate 20, as illustrated in FIGS. 3B and 5B.

For example, the depth d, the width W, and the pitch p2 of the V grooves 28 can be 0.04 mm to 0.1 mm, 0.06 mm to 0.14 mm, and 0.5 mm, respectively.

Figure 6A:
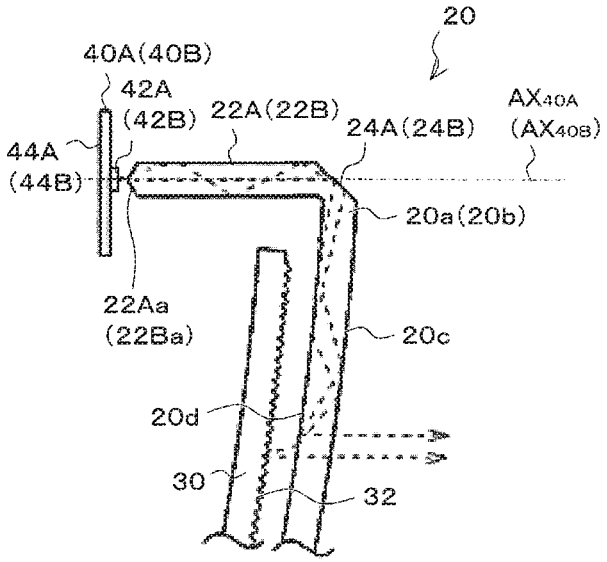
FIG. 6A is a partial cross-sectional view of the vehicle lighting fixture 10 taken along line A-A of FIG. 3A.
Figure 6B:
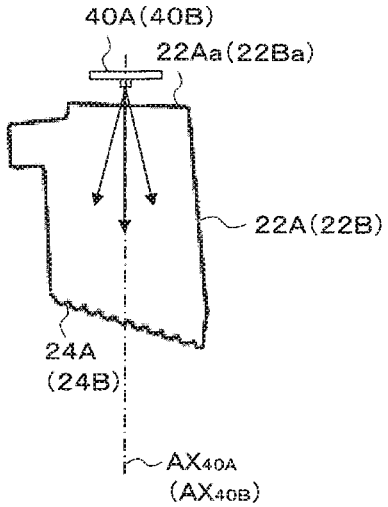
FIG. 6B is a partial cross-sectional view of the vehicle lighting fixture 10 taken along line B-B of FIG. 3A.

FIG. 6A is a partial cross-sectional view of the vehicle lighting fixture 10 taken along line A-A of FIG. 3A, and FIG. 6B is a partial cross-sectional view of the vehicle lighting fixture 10 taken along line B-B of FIG. 3A.

As illustrated in FIGS. 2 and 6A, the light guide plate 20 can be provided with a first extension portion 22A. Specifically, the first extension portion 22A can be provided to the first end portion 20*a* of the light guide plate 20 at its base end portion and extend rearward.

The first extension portion 22A can have a tip end portion where a cylindrical lens surface 22Aa can be formed to receive the light from the first light source 40A. The cylindrical lens surface 22Aa can be configured to extend in a direction perpendicular to the thickness direction of the first extension portion 22A (or in a direction perpendicular to the paper surface of FIG. 6A). The top portion (apex) of the cylindrical lens surface 22Aa can be disposed to be directed to the center of the first light source 40A.

The light from the first light source 40A can enter the first extension portion 22A through the cylindrical lens surface 22Aa so as to be condensed in the thickness direction of the first extension portion 22A (in the vertical direction in FIG. 6A) by the cylindrical lens surface 22Aa.

It should be noted that the light from the first light source 40A is not condensed in the direction perpendicular to the thickness direction of the first extension portion 22A (in the direction perpendicular to the paper surface of FIG. 6A), but is diffused (see FIG. 6B).

Between the base end portion of the first extension portion 22A and the first end portion 20*a* of the light guide plate 20, there can be provided a first reflection surface 24A.

Figure 7:
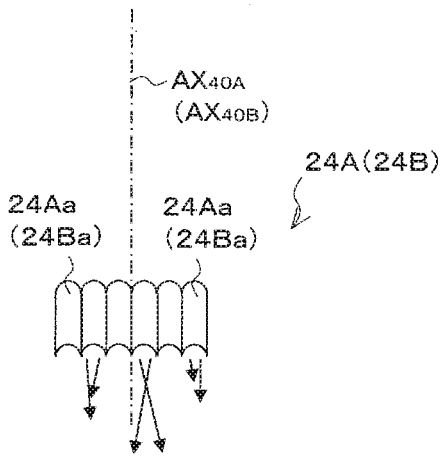
FIG. 7 is a partial schematic view of a first reflection surface 24A of the vehicle lighting fixture 10.

The first reflection surface 24A can be disposed to be inclined such that the light emitted from the first light source 40A and guided within the first extension portion 22A can be internally reflected by the first reflection surface 24A to enter the light guide plate 20 through the first end portion 20*a* (see FIG. 6A). As illustrated in FIG. 7, the first reflection surface 24A can include a plurality of inner cylindrical lens surfaces 24Aa recessed rearward. The meaning of "recessed rearward" used here is that the cylindrical lens portions are projected outward of the base end portion of the first extension portion 22A (rightward in FIG. 6A).

Part of the light emitted from the first light source 40A and guided within the first extension 22A can impinge on the first reflection surface 24A and be diffused by the cylindrical lens surfaces 24Aa located in the vicinity of the optical axis $AX_{40A}$ of the first light source 40A. On the other hand, another part of the light emitted from the first light source 40A and guided within the first extension 22A can impinge on the first reflection surface 24A and be collimated (or substantially collimated) by the cylindrical lens surfaces 24Aa located in positions apart from the optical axis $AX_{40A}$ of the first light source 40A. The arrows in FIG. 7 show this optical function.

This can make the amount of light in the width direction (in the left-right direction in FIGS. 6A and 7) uniform (or substantially uniform) where the light is emitted from the first light source 40A and internally reflected by the first reflection surface 24A to enter the light guide plate 20 through the first end portion 20*a*.

As illustrated in FIGS. 2 and 6A, the light guide plate 20 can be provided with a second extension portion 22B. Specifically, the second extension portion 22B can be provided to the second end portion 20*b* of the light guide plate 20 at its base end portion and extend rearward.

The second extension portion 22B can have a tip end portion where a cylindrical lens surface 22Ba can be formed to receive the light from the second light source 40B. The cylindrical lens surface 22Ba can be configured to extend in a direction perpendicular to the thickness direction of the second extension portion 22B (or in the direction perpendicular to the paper surface of FIG. 6A). The top portion (apex) of the cylindrical lens surface 22Ba can be disposed to be directed to the center of the second light source 40B.

The light from the second light source 40B can enter the second extension portion 22B through the cylindrical lens surface 22Ba so as to be condensed in the thickness direction of the second extension portion 22B (in the vertical direction in FIG. 6A) by the cylindrical lens surface 22Ba.

It should be noted that the light from the second light source 40B is not condensed in the direction perpendicular to the thickness direction of the second extension portion 22B (in the direction perpendicular to the paper surface of FIG. 6A), but is diffused (see FIG. 6B).

Between the base end portion of the second extension portion 22B and the second end portion 20*b* of the light guide plate 20, there can be provided a second reflection surface 24B.

The second reflection surface 24B can be disposed to be inclined such that the light emitted from the second light source 40B and guided within the second extension portion 22B can be internally reflected by the second reflection surface 24B to enter the light guide plate 20 through the second end portion 20*b* (see FIG. 6A). As illustrated in FIG. 7, the second reflection surface 24B can include a plurality of inner cylindrical lens surfaces 24Ba recessed rearward. The meaning of "recessed rearward" used here is that the cylindrical lens portions are projected outward of the base end portion of the second extension portion 22B (rightward in FIG. 6A).

Part of the light emitted from the second light source 40B and guided within the second extension 22B can impinge on the second reflection surface 24B and be diffused by the cylindrical lens surfaces 24Ba located in the vicinity of the optical axis $AX_{40B}$ of the second light source 40B. On the other hand, another part of the light emitted from the second light source 40B and guided within the second extension 22B can impinge on the second reflection surface 24B and be collimated (or substantially collimated) by the cylindrical lens surfaces 24Ba located in positions apart from the optical axis $AX_{40B}$ of the second light source 40B. The arrows in FIG. 7 show this optical function.

This can make the amount of light in the width direction (in the left-right direction in FIGS. 6A and 7) uniform (or substantially uniform) where the light is emitted from the second light source 40B and internally reflected by the second reflection surface 24B to enter the light guide plate 20 through the second end portion 20*b*.

The above-described light guide plate 20 can be molded by injection molding a transparent resin, such as an acrylic resin or a polycarbonate resin, using a metal mold.

As illustrated in FIG. 2, the auxiliary reflecting mirror 30 can be disposed on the side closer to the rear surface of the light guide plate 20. The auxiliary reflecting mirror 30 can be a cylindrical member including a front opening end surface 32 that faces (or is in close contact with) the rear surface 20*d* of the light guide plate 20, and a cylindrical portion 34 extending rearward from the outer rim of the front opening end surface 32.

It should be noted that the auxiliary reflecting mirror 30 is not a perfect cylinder, but can include a cutout portion S2 formed at a position corresponding to the cutout portion S1 of the light guide plate 20. Accordingly, the front opening end surface 32 can be a circular arc-shaped surface including the cutout portion S2.

The front opening end surface 32 can be formed in a substantially similar shape to the rear surface 20*d* of the light guide plate 20. Specifically, the front opening end surface 32 can be formed in a substantially circular truncated conical shape where a part of the front opening end surface 32 on an outer peripheral side is located rearward more than a part of the front opening end surface 32 on an inner peripheral side is, corresponding to the rear surface 20*d* of the light guide plate 20.

The front opening end surface 32 can be subjected to an aluminum deposition treatment in order for light leaked from the rear surface 20*d* of the light guide plate 20 to be returned to the light guide plate 20. Alternatively, the rear surface 20*d* of the light guide plate 20 may be subjected to an aluminum deposition treatment. In this case, such an auxiliary reflecting mirror 30 can be omitted.

The above-described auxiliary reflecting mirror 30 can be molded by injection molding a synthetic resin, such as an acrylic resin or a polycarbonate resin, using a metal mold.

The light guide plate 20 configured as described above can be fixed to the auxiliary reflecting mirror 30 while the second extension portion 22B of the light guide plate 20 is inserted into a through hole 30*a* formed in the auxiliary reflection mirror 30 in a state where the rear surface 20*d* of the light guide plate 20 faces (or is in close contact with) the front opening end surface 32 of the auxiliary reflecting mirror 30 (see FIG. 6A).

As illustrated in FIG. 2, the first light source 40A can include a semiconductor light emitting element 42A such as an LED, and a substrate 44A on which the semiconductor light emitting element 42A is mounted. The semiconductor light emitting element 42A can emit light that enters the light guide plate 20 through the first end portion 20*a* to be guided within the light guide plate 20. The first light source 40A can be fixed to the auxiliary reflecting mirror 30, for example, while the semiconductor light emitting element 42A faces the cylindrical lens surface 22Aa of the first extension portion 22A (see FIGS. 6A and 6B).

The second light source 40B can include a semiconductor light emitting element 42B such as an LED, and a substrate 44B on which the semiconductor light emitting element 42B is mounted. The semiconductor light emitting element 42B can emit light that enters the light guide plate 20 through the second end portion 20*b* to be guided within the light guide plate 20. The second light source 40B can be fixed to the auxiliary reflecting mirror 30, for example, while the semiconductor light emitting element 42B faces the cylindrical lens surface 22Ba of the second extension portion 22B (see FIGS. 6A and 6B).

In the vehicle lighting fixture 10 configured as described above, the light emitted from the first light source 40A can enter the first extension portion 22A through the cylindrical lens surface 22Aa thereof, so that the light can be condensed in the thickness direction of the first extension portion 22A by the action of the cylindrical lens surface 22Aa. The condensed light can be guided within the first extension portion 22A and then internally reflected by the first reflection surface 24A to enter the light guide plate 20 through the first end portion 20*a*.

The light emitted from the first light source 40A and entering the light guide plate 20 can be internally reflected by the front light emission surface 20*c*, the rear surface 20*d*, the inner peripheral surface 20*e*, and the outer peripheral surface 20*f* of the light guide plate 20 to be guided toward the second end portion 20*b* of the light guide plate 20. Since the light guide plate 20 is formed in a substantially circular truncated conical shape where the part of the light guide plate 20 on the outer peripheral side (outer peripheral surface 20*f* side) is located rearward more than the part of the light guide plate 20 on the inner peripheral side (inner peripheral surface 20*e* side) is, the light can be internally reflected mainly by partial surfaces, on the outer peripheral side, of the respective cylindrical lens surfaces 20*c*1 provided to the front light emission surface 20*c* of the light guide plate 20 in a concentric manner, so that the light can be guided to farther portions of the light guide plate 20.

Then, part of the light emitted from the first light source 40A and guided within the light guide plate 20 can be diffused and reflected by the structural body 20*d*1 provided to the rear surface 20*d*, thereby partly exiting through the front light emission surface 20*c* of the light guide plate 20.

Similarly, the light emitted from the second light source 40B can enter the second extension portion 22B through the cylindrical lens surface 22Ba thereof, so that the light can be condensed in the thickness direction of the second extension portion 22B by the action of the cylindrical lens surface 22Ba. The condensed light can be guided within the second extension portion 22B and then internally reflected by the second reflection surface 24B to enter the light guide plate 20 through the second end portion 20*b*.

The light emitted from the second light source 40B and entering the light guide plate 20 can be internally reflected by the front light emission surface 20*c*, the rear surface 20*d*, the inner peripheral surface 20*e*, and the outer peripheral surface 20*f* of the light guide plate 20 to be guided toward the first end portion 20*a* of the light guide plate 20. Since the light guide plate 20 is formed in a substantially circular truncated conical shape where the part of the light guide plate 20 on the outer peripheral side (outer peripheral surface 20*f* side) is located rearward more than the part of the light guide plate 20 on the inner peripheral side (inner peripheral surface 20*e* side) is, the light can be internally reflected mainly by surfaces, on the outer peripheral side, of the cylindrical lens surfaces 20*c*1 provided to the front light emission surface 20*c* of the light guide plate 20, so that the light can be guided to farther portions of the light guide plate 20.

Then, part of the light emitted from the second light source 40B and guided within the light guide plate 20 can be diffused and reflected by the structural body 20*d*1 provided to the rear surface 20*d*, thereby partly exiting through the front light emission surface 20*c* of the light guide plate 20.

With this configuration, the light that is emitted from the first light source 40A can enter the light guide plate 20 through the first end portion 20*a* of the light guide plate 20 and be guided within the light guide plate 20. The light emitted from the second light source 40B can enter the light guide plate 20 through the second end portion 20*b* of the light guide plate 20 and be guided within the light guide plate 20. Then, these beams of light from the first and second end portions 20*a* and 20*b* can exit through the front light emission surface 20*c*, while the light can be caused to be uniformly or substantially uniformly projected through the front light emission surface 20*c* (light emission region A) when seen from its front direction and its front oblique direction. Thus, the visual recognizability of the vehicle lighting fixture including such a light guide plate 20 can be improved even when seen from its front oblique direction.

A description will next be given of the advantageous effects of the light guide plate 20 with the above-described configuration while comparing with first to third comparative examples.

Figure 8:
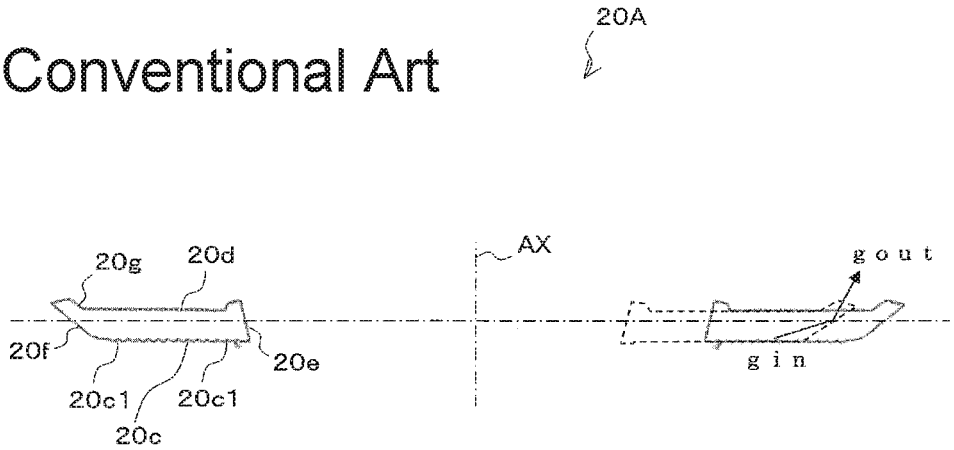
FIG. 8 Conventional Art
FIG. 8 is a cross-sectional view of a light guide plate of a first comparative example.

FIG. 8 is a cross-sectional view illustrating a light guide plate 20A according to the first comparative example.

As illustrated in FIG. 8, the light guide plate 20A according to the first comparative example is different from the above-described light guide plate 20 in that the front light emission surface 20*c* and the rear surface 20*d* on the outer peripheral surface 20*f* side and the inner peripheral surface 20*e* side are flush or substantially flush with each other relative to the axial direction AX direction of the light guide plate 20. The other configuration of the light guide plate 20A is almost the same as that of the light guide plate 20.

As a result of trial production of the light guide plate 20A according to the first comparative example, the light guide plate 20A cannot cause the light to be uniformly projected through the light emission region A of the front light emission surface 20*c* when seen from its front direction and its front oblique direction (meaning that the light emission region A is seen with unevenness in light intensity distribution).

As in the light guide plate 20, the light guide plate 20A according to the first comparative example includes the outer peripheral surface 20*f* inclined rearward by the angle θ with respect to the front light emission surface 20*c*. Thus, the light emitted from the first light source 40A and the second light source 40B and entering the light guide plate 20A may exit the light guide plate 20A in an earlier stage by the internal reflection on the outer peripheral surface 20*f* through the outer peripheral portion (i.e., the portion between the outer peripheral surface 20*f* and the extension surface 20*g* of the rear surface 20*d*) to the outside. (See the arrows gin and gout in FIG. 8.) This leads to the illumination unevenness of the light emission region A.

FIG. 8 is a cross-sectional view illustrating a light guide plate 20B according to the second comparative example.

Figure 9:
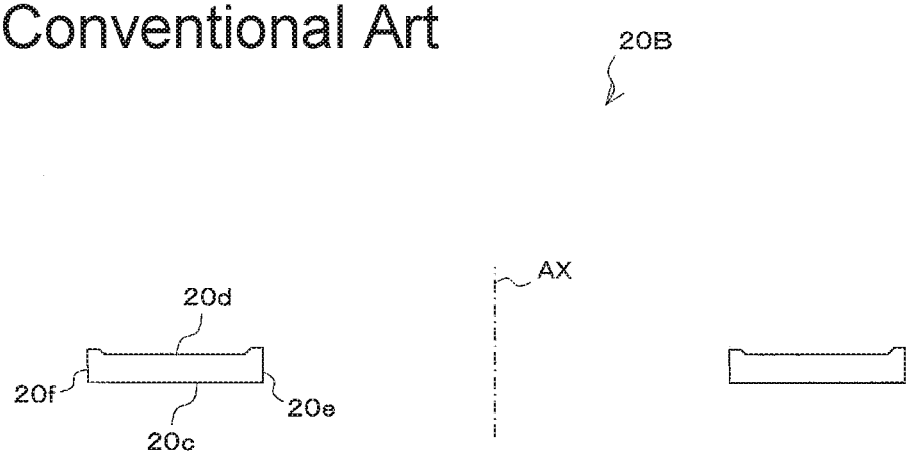
FIG. 9 Conventional Art
FIG. 9 is a cross-sectional view of a light guide plate of a second comparative example.

As illustrated in FIG. 9, the light guide plate 20B according to the second comparative example is different from the above-described light guide plate 20 in that the outer peripheral surface 20*f* is inclined by 90 degrees rearward with respect to the front light emission surface 20*c*. The other configuration of the light guide plate 20B is almost the same as that of the light guide plate 20.

With this outer peripheral surface 20*f* inclined rearward by 90 degrees with respect to the front light emission surface 20*c*, the light guide plate 20B according to the second comparative example can prevent the light emitted from the first and second light sources 40A and 40B and entering the light guide plate 20B from exiting to the outside of the light guide plate 20B in an earlier stage.

However, the light guide plate 20 of the above-described exemplary embodiment can allow the light to be projected through the front light emission surface 20*c* (light emission region A) uniformly more than the light guide plate 20B according to the second comparative example when seen from its front direction and its front oblique direction, meaning that the visual recognizability thereof even when seen from its front oblique direction can be improved.

This is because the light guide plate 20 can be formed in a substantially circular truncated conical shape where a part of the light guide plate 20 on the outer peripheral side (outer peripheral surface 20*f* side) is located rearward more than a part of the light guide plate 20 on the inner peripheral side (inner peripheral surface 20*e* side) is. Furthermore, the plurality of cylindrical lens surfaces 20*c*1 are provided to the front light emission surface 20*c* of the light guide plate 20 in a concentric manner and extend in a circular arc shape. Therefore, it is surmised that the partial surfaces, on the outer peripheral side, of the respective cylindrical lens surfaces 20*c*1 provided to the front light emission surface 20*c* of the light guide plate 20 in a concentric manner can function like the outer peripheral surface 20*f* of the second comparative example (see FIG. 9). Thus, the light emitted from the first and second light sources 40A and 40B and entering the light guide plate 20 can be internally reflected mainly by those partial surfaces, so that the light can be guided to farther portions of the light guide plate 20, and the light can be caused to be uniformly projected through the front light emission surface 20*c* (light emission region A).

Figure 10:
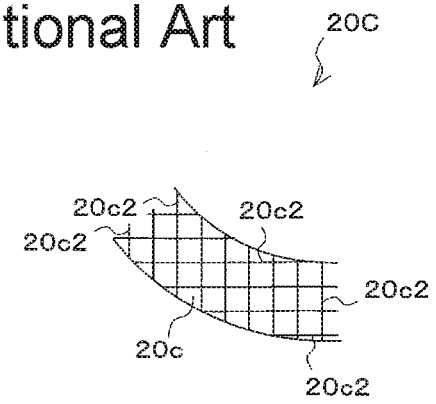
FIG. 10 Conventional Art
FIG. 10 is a partial front view of a third comparative example.

FIG. 10 is a partial front view illustrating part of a light guide plate 20C according to the third comparative example.

As illustrated in FIG. 10, the light guide plate 20C according to the third comparative example is different from the above-described light guide plate 20 in that the front light emission surface 20*c* is provided with a plurality of square pyramids, which are formed by a plurality of vertical and horizontal V grooves 20*c*2 orthogonal to one another in the front light emission surface 20*c*. The other configuration of the light guide plate 20C is almost the same as that of the light guide plate 20.

As a result of trial production of the light guide plate 20C according to the third comparative example, the light guide plate 20C cannot cause the light to be uniformly projected through the light emission region A of the front light emission surface 20*c* (meaning that the light emission region A is seen with unevenness in light intensity distribution).

This is because the light guide plate 20C according to the third comparative example is configured such that the plurality of square pyramids may randomly reflect the light emitted from the first and second light sources 40A and 40B and entering the light guide plate 20C. Thus, the light emitted from the first and second light sources 40A and 40B and entering the light guide plate 20C may exit the light guide plate 20C in an earlier stage by the random reflection on the square pyramids of the front light emission surface 20*c* through the outer peripheral portion (i.e., the portion between the outer peripheral surface 20*f* and the extension surface 20*g* of the rear surface 20*d*) to the outside. This leads to the illumination unevenness of the light emission region A.

However, the light guide plate 20 of the above-described exemplary embodiment can allow the light to be projected through the front light emission surface 20*c* (light emission region A) uniformly more than the light guide plate 20C according to the third comparative example when seen from its front direction and its front oblique direction, meaning that the visual recognizability thereof even when seen from its front oblique direction can be improved. The already detailed reasons will not be repeated here.

Furthermore, as a result of trial production of the light guide plate 20C according to the third comparative example, there is generated moiré during turning-off of the first and second light sources 40A and 40B due to the overlapping of the plurality of square pyramids provided to the front light emission surface 20*c* and the plurality of V grooves 28 provided to the rear surface 20*d* of the light guide plate 20C. As a result, it has been found that the outer appearance deteriorates.

On the contrary, the light guide plate 20 of the exemplary embodiment according to the presently disclosed subject matter can prevent moiré from generating.

This is because the front light emission surface 20*c* of the light guide plate 20 is provided with not the plurality of square pyramids but the plurality of cylindrical lens surfaces 20*c*1 formed in a concentric manner and extending in a circular arc shape.

The present inventor confirmed that even when the plurality of cylindrical lens surfaces 20*c*1 provided to the front light emission surface 20*c* of the light guide plate 20 overlap with the plurality of V grooves 20 provided to the rear surface 20*d* in a radial manner, no moiré is generated during the turning-off of the first and second light sources 40A and 40B.

As described above, the vehicle lighting fixture 10 utilizing the circular arc-shaped light guide plate 20 can improve the visual recognizability when seen from its front direction and its front oblique direction relative to the light guide plate 20.

This is because the light guide plate 20 can be formed in a substantially circular truncated conical shape where the outer part of the light guide plate 20 on the outer peripheral side is located rearward more than the inner part of the light guide plate 20 on the inner peripheral side is.

Further, according to this exemplary embodiment, the vehicle lighting fixture 10 can provide a novel appearance.

This is because the light guide plate 20 in a circular arc shape can be formed in a substantially circular truncated conical shape where the outer part of the light guide plate 20 on the outer peripheral side is located rearward more than the inner part of the light guide plate 20 on the inner peripheral side is, and the plurality of cylindrical lens surfaces being recessed rearward are formed in the front light emission surface 20*c* to extend in a circular arc shape and in a concentric manner.

In the present exemplary embodiment, the vehicle lighting fixture 10 can include the first light source 40A configured to emit light that can enter the light guide plate 20 through the first end portion 20*a* and be guided within the light guide plate 20, and the second light source 40B configured to emit light that can enter the light guide plate 20 through the second end portion 20*b* and be guided within the light guide plate 20. According to this exemplary embodiment, the light can be projected through the front light emission surface 20*c* of the light guide uniformly or substantially uniformly when seen from its front direction and its front oblique direction. Thus, the visual recognizability of the vehicle lighting fixture 10 including such a light guide plate 20 can be improved even when seen from its front oblique direction.

Furthermore, according to this exemplary embodiment, the light guide plate 20 can include the front light emission surface 20*c* to which the plurality of cylindrical lens surfaces 20*c*1 being recessed rearward are provided to extend in a cylindrical arc shape and in a concentric manner and the rear surface 20*d* to which the plurality of V grooves 20 are provided extending radially relative to the axial line AX of the light guide plate 20. Thus no moiré is generated during the turning-off of the first and second light sources 40A and 40B even when the plurality of cylindrical lens surfaces 20*c*1 on the front light emission surface 20*c* and the plurality of V grooves 28 on the rear surface 20*d* overlap with each other.

The vehicle lighting fixture 10 according to this exemplary embodiment is configured such that the light emitted from the first light source 40A is allowed to enter the light guide plate 20 by deflecting the light towards the light guide plate 20 by about 90 degrees by means of the first extension portion 22A and the first reflection surface 24A. Furthermore, the light emitted from the second light source 40B is allowed to enter the light guide plate 20 by deflecting the light towards the light guide plate 20 by about 90 degrees by means of the second extension portion 22B and the second reflection surface 24B. Therefore, the first and second light sources 40A and 40B can be disposed behind the light guide plate 20 (as well as the auxiliary reflecting mirror) so as to be concealed behind.

In this exemplary embodiment, the first reflection surface 24A and the second reflection surface 24B can be provided with a plurality of cylindrical lens surfaces 24Aa (24Ba) being recessed rearward. Thus, the light that is emitted from the first light source 40A (second light source 40B) and internally reflected by the first reflection surface 24A (second reflection surface 24B) to enter the light guide plate 20 through the first end portion 20*a* (second end portion 20) can be distributed uniformly or substantially uniformly in light amount in a width direction (in the left-right direction in FIGS. 6B and 7).

A description will now be given of modified examples.

In the above-described exemplary embodiment, a description has been given of the example in which the front light emission surface 20*c* of the light guide plate 20 is provided with the plurality of cylindrical lens surfaces 20*c*1 being recessed rearward and extending in a circular arc shape and in a concentric manner. However, this is not limitative. For example, the front light emission surface 20*c* of the light guide plate 20 may be provided with a plurality of V grooves being recessed rearward, or the like lens cut surfaces extending in a circular arc shape and in a concentric manner.

In the above-described exemplary embodiment, a description has been given of the example in which the rear surface 20*d* of the light guide plate 20 is provided with the plurality of V grooves 28 extending in a radial manner relative to the axis line AX of the light guide plate 20 as the structural body 20*d*1. However this is not limitative as long as the structural body 20*d*1 can be configured to cause the light guided within the light guide plate 20 to exit through the front light emission surface 20*c* by diffusion, reflection, and the like function. Thus, the structural body 20*d*1 can take a triangular pyramidal shape, a square pyramidal shape, a hexagonal pyramidal shape, a semi-spherical dotted shape, a conical dotted shape, or the like. The structural bodies 20*d*1 can be arranged in any arbitrary arrangement, such as a comb shape arrangement, a line arrangement, a random arrangement, or the like.

In the above-described exemplary embodiment, a description has been given of the example in which semiconductor light emitting elements such as LEDs are used as the first and second light sources 40A and 40B. However, this is not limitative and the light sources may adopt any light source, such as a bulb light source, in addition to the semiconductor light emitting element.

In the above-described exemplary embodiment, a description has been given of the example in which the vehicle lighting fixture 10 adopts the first extension portion 22A and the first reflection surface 24A, and the second extension portion 22B and the second reflection surface 24B. However, this is not limitative, and they may be omitted according to the intended use applications.

In this case, the first light source 40A can be disposed to directly face to the first end portion 20*a* of the light guide plate 20, and the second light source 40B can be disposed to directly face to the second end portion 20*b* of the light guide plate 20, so that the light emitted from the first and second light sources 40A and 40B can be allowed to directly enter the light guide plate 20 through the respective end portions 20*a* and 20*b*.

In the above-described exemplary embodiment, a description has been given of the example in which the adopted light source includes two types of the first and second light sources 40A and 40B. However, this is not limitative, and any one of them can be used alone.

In the above-described exemplary embodiment, a description has been given of the example in which the vehicle lighting fixture 10 is used as a front position lamp (or DRL lamp). However, this is not limitative and the vehicle lighting fixture of the presently disclosed subject matter can be used as other functional lamps, such as a turn signal lamp, and the like.

The various numerical values shown in the above-described exemplary embodiments are for illustrative purposes, and not limitative. Obviously, the presently disclosed subject matter can adopt various different appropriate numerical values.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting fixture comprising:

a light guide portion; and at least one light source configured to emit light that is allowed to enter the light guide portion, the light guide portion including a light guide plate formed in a circular arc shape and having a first end portion, a second end portion, a front light emission surface extending between the first end portion and the second end portion in a circular arc shape, a rear surface opposite to the front light emission surface, an inner peripheral surface, an outer peripheral surface, a plurality of lens cut surfaces formed in the front light emission surface to extend in a circular arc shape, the lens cut surfaces being recessed rearward and formed in a concentric manner, and a structural body provided to the rear surface of the light guide plate, the structural body being configured to diffuse and reflect light guided within the light guide plate in order for the light to exit through the front light emission surface, wherein the front light emission surface of the light guide plate has an inner peripheral side edge and an outer peripheral side edge that is located further rearward than the inner peripheral side edge so that the front light emission surface is inclined from the inner peripheral side edge to the outer peripheral side edge rearward, the rear surface of the light guide plate has an inner peripheral side edge and an outer peripheral side edge that is located further rearward than the inner peripheral side edge so that the front light emission surface is inclined from the inner peripheral side edge to the outer peripheral side edge rearward, the light guide plate is formed in a substantially circular truncated conical shape where a part of the light guide plate on an outer peripheral side is located rearward more than a part of the light guide plate on an inner peripheral side is, and a portion defined by the front light emission surface and the rear surface of the light guide plate has a plate shape.

2. The vehicle lighting fixture according to claim 1, wherein the at least one light source includes:

a first light source configured to emit light that can enter the light guide plate through the first end portion and be guided within the light guide plate; and a second light source configured to emit light that can enter the light guide plate through the second end portion and be guided within the light guide plate.

3. The vehicle lighting fixture according to claim 2, wherein the vehicle lighting fixture satisfies a relation of $LT \leq MT \leq 3 \times LT$ where the circular truncated conical shape has a center axis being defined as an axial line of the light guide plate and LT represents a thickness of the light guide plate along the axial line of the light guide plate and MT represents a depth of the light guide plate along the axial line of the light guide plate.

4. The vehicle lighting fixture according to claim 1, wherein the vehicle lighting fixture satisfies a relation of $LT \leq MT \leq 3 \times LT$ where the circular truncated conical shape has a center axis being defined as an axial line of the light guide plate and LT represents a thickness of the light guide plate along the axial line of the light guide plate and MT represents a depth of the light guide plate along the axial line of the light guide plate.

5. The vehicle lighting fixture according to claim 1, wherein the light guide plate includes an outer peripheral surface inclined rearward by an acute angle with respect to the front light emission surface.

6. A vehicle lighting fixture comprising:

a light guide portion; and at least one light source configured to emit light that is allowed to enter the light guide portion, the light guide portion including a light guide plate formed in a circular arc shape and having a first end portion, a second end portion, a front light emission surface extending between the first end portion and the second end portion in a circular arc shape, a rear surface opposite to the front light emission surface, an inner peripheral surface, an outer peripheral surface, a plurality of lens cut surfaces formed in the front light emission surface to extend in a circular arc shape, the lens cut surfaces being recessed rearward and formed in a concentric manner, and a structural body provided to the rear surface of the light guide plate, the structural body being configured to diffuse and reflect light guided within the light guide plate in order for the light to exit through the front light emission surface, wherein the light guide plate is formed in a substantially circular truncated conical shape where a part of the light guide plate on an outer peripheral side is located further rearward than a part of the light guide plate on an inner peripheral side is, and the lens cut surfaces are each a cylindrical lens surface, the circular truncated conical shape has a center axis being defined as an axial line of the light guide plate, and the structural body is constituted by a plurality of V grooves provided radially with respect to the axial line of the light guide plate.

7. The vehicle lighting fixture according to claim 6, wherein the at least one light source includes:

a first light source configured to emit light that can enter the light guide plate through the first end portion and be guided within the light guide plate; and a second light source configured to emit light that can enter the light guide plate through the second end portion and be guided within the light guide plate.

8. The vehicle lighting fixture according to claim 7, wherein the vehicle lighting fixture satisfies a relation of $LT \leq MT \leq 3 \times LT$ where LT represents a thickness of the light guide plate along the axial line of the light guide plate and MT represents a depth of the light guide plate along the axial line of the light guide plate.

9. The vehicle lighting fixture according to claim 6, wherein the vehicle lighting fixture satisfies a relation of $LT \leq MT \leq 3 \times LT$ where LT represents a thickness of the light guide plate along the axial line of the light guide plate and MT represents a depth of the light guide plate along the axial line of the light guide plate.

10. The vehicle lighting fixture according to claim 6, wherein the light guide plate includes an outer peripheral surface inclined rearward by an acute angle with respect to the front light emission surface.

11. A vehicle lighting fixture comprising:

a light guide portion; and at least one light source configured to emit light that is allowed to enter the light guide portion, the light guide portion including a light guide plate formed in a circular arc shape and having a first end portion, a second end portion, a front light emission surface extending between the first end portion and the second end portion in a circular arc shape, a rear surface opposite to the front light emission surface, an inner peripheral surface, an outer peripheral surface, a plurality of lens cut surfaces formed in the front light emission surface to extend in a circular arc shape, the lens cut surfaces being recessed rearward and formed in a concentric manner, and a structural body provided to the rear surface of the light guide plate, the structural body being configured to diffuse and reflect light guided within the light guide plate in order for the light to exit through the front light emission surface, wherein the light guide plate is formed in a substantially circular truncated conical shape where a part of the light guide plate on an outer peripheral side is located further rearward than a part of the light guide plate on an inner peripheral side is, the at least one light source includes: a first light source configured to emit light that can enter the light guide plate through the first end portion and be guided within the light guide plate; and a second light source configured to emit light that can enter the light guide plate through the second end portion and be guided within the light guide plate, the light guide plate includes a first extension portion having a base end portion provided to the first end portion of the light guide plate and extending rearward, and a second extension portion having a base end portion provided to the second end portion of the light guide plate and extending rearward, the first extension portion has a tip end portion provided with a cylindrical lens surface through which the light from the first light source enters the first extension portion, a first reflection surface disposed to be inclined such that the light emitted from the first light source and guided within the first extension portion is internally reflected by the first reflection surface to enter the light guide plate through the first end portion is provided between the base end portion of the first extension portion and the first end portion of the light guide plate, the second extension portion has a tip end portion provided with a cylindrical lens surface through which the light from the second light source enters the second extension portion, and a second reflection surface disposed to be inclined such that the light emitted from the second light source and guided within the second extension portion is internally reflected by the second reflection surface to enter the light guide plate through the second end portion is provided between the base end portion of the second extension portion and the second end portion of the light guide plate.

12. The vehicle lighting fixture according to claim 11, wherein the first reflection surface and the second reflection surface are each provided with a plurality of cylindrical lens surfaces recessed rearward.

* * * * *